US006005177A

United States Patent [19]

Malta

[11] Patent Number: 6,005,177

[45] Date of Patent: Dec. 21, 1999

[54] HANDCHIME WITH DAMPER BLOCK

[75] Inventor: Jacob H. Malta, New Britain, Pa.

[73] Assignee: Malmark, Inc., Plumsteadville, Pa.

[21] Appl. No.: 09/058,229

[22] Filed: Apr. 10, 1998

Related U.S. Application Data

[60] Provisional application No. 60/044,610, Apr. 24, 1997.

[51] Int. Cl.[6] ..... G10D 13/08

[52] U.S. Cl. ..... 84/404; 84/402

[58] Field of Search ..... 84/402, 403, 404, 84/408, 409

[56] References Cited

U.S. PATENT DOCUMENTS 4,325,281 4/1982 Hardy ..... 84/411 M 4,599,932 7/1986 Malta ..... 84/404

*Primary Examiner*—Robert E. Nappi

*Assistant Examiner*—Shih-Yung Hsieh

*Attorney, Agent, or Firm*—Gregory J. Gore

[57] ABSTRACT

A handchime includes a main tube with a clapper assembly for striking one of two tines at the end of a tubular body. An elastomeric damper block is fitted in compression between the inside surfaces of the side walls of the tine which the clapper strikes. The damper block is located at a distance approximately one-third the length of the tine from its base. The damper block includes raised portions in contacting relation with the horizontal inside surface of the tine, and is preferably affixed by an adhesive.

14 Claims, 2 Drawing Sheets

HANDCHIME WITH DAMPER BLOCK

Priority based upon Provisional Patent application Ser. No. 60/044,610, filed Apr. 24, 1997 entitled "Handchime Damper Block", is hereby claimed.

FIELD OF THE INVENTION

The present invention relates to a tubular-bell-type musical instrument. More specifically, it relates to a tubular handchime with an integral clapper.

BACKGROUND OF THE INVENTION AND DESCRIPTION OF PRIOR ART

Handchimes which produce a musical note consisting of a tubular body with an integral clapper are well-known in the musical arts. A handchime of this type is disclosed in U.S. Pat. No. 4,599,932 issued to Malta. A problem with this type of instrument is unwanted overtones or harmonics of the fundamental tone which are created by the vibrating tines that produce the musical note. The purest sound is produced when only the fundamental frequency alone is heard.

As disclosed in the Malta patent, a damper pad slidably affixed to the clapper bar may be used to control the sharpness of the sound. By positioning the damper pad along the top of the upper tine of the instrument, the amount of sustain of the sound may be controlled. Because the damper pad moves with the clapper, a totally unsustained note may be played by holding the handchime at a backward angle so that the damper pad does not contact the tines after the note is struck. Although the adjustable damper pad of the prior art devices has been used to control the sustain of the note, there has been no regard to intentionally isolate the fundamental tone.

SUMMARY OF THE INVENTION

In order to provide a higher quality sound from a handchime, the inventor has recognized that by damping the overtones, the fundamental frequency of the handchime can be more clearly heard. More importantly, he has recognized that the unwanted overtones emanate from the vibrating sides of the handchime tines and not the major surfaces (i.e., top and bottom portions). As a result, it has also been found that damping the vibrations from the sides of the tine, produces a superior sound.

The mechanical solution to reducing the overtones is provided by an accurately positioned internal damper block of elastomeric material internally wedged between the opposing sides of the upper tine. The damper block should be located on the vibrating structure approximately at the antinode of the first harmonic of the fundamental frequency of the instrument. Fixed at this ideal location, the damper block provides effective damping of the overtone while minimizing its effect on the fundamental tone. Damping the vibrating sides of a handchime has never been tried before.

More specifically, the applicant has invented a handchime, comprising: a main tube having two opposite ends; a first of the ends being forked and having tines; the second of the ends being suitable for grasping as a handle; an elastomeric damper block fitted in compression between inside surfaces of the side walls of one of the tines; and clapper means for striking the tines, the clapper means being attached to the main tube by hinge means. The damper block is located at a distance approximately one-third of the length of the tine from a base of the tine, and includes raised portions in contacting relationship with the horizontal inside surface of the tine. The damper block is secured to the side walls by an adhesive. The side surfaces of the present invention are planar and the tubular body has a rectangular cross-section.

The present invention thus provides a great advantage over the prior art damping pad in that it produces a beneficial effect on the sides of the tine where it is needed most. Furthermore, it is permanently fixed in place during tuning at the factory and thus cannot be misaligned by the handchime ringer. Also, as described above, the degree of damping is enhanced by the pressure supplied by compression of an elastomeric material. Finally, the damping block is applied to the handchime internally and without effect on the clapper assembly. This provides efficiency, economy and less susceptibility to damage.

Other advantages and qualities of the present invention which are improvements over the prior art will be readily recognized by those of skill in the art from the following drawings and description of the preferred embodiment.

DESCRIPTION OF THE PREFERRED EMBODIMENT

Figure 1:
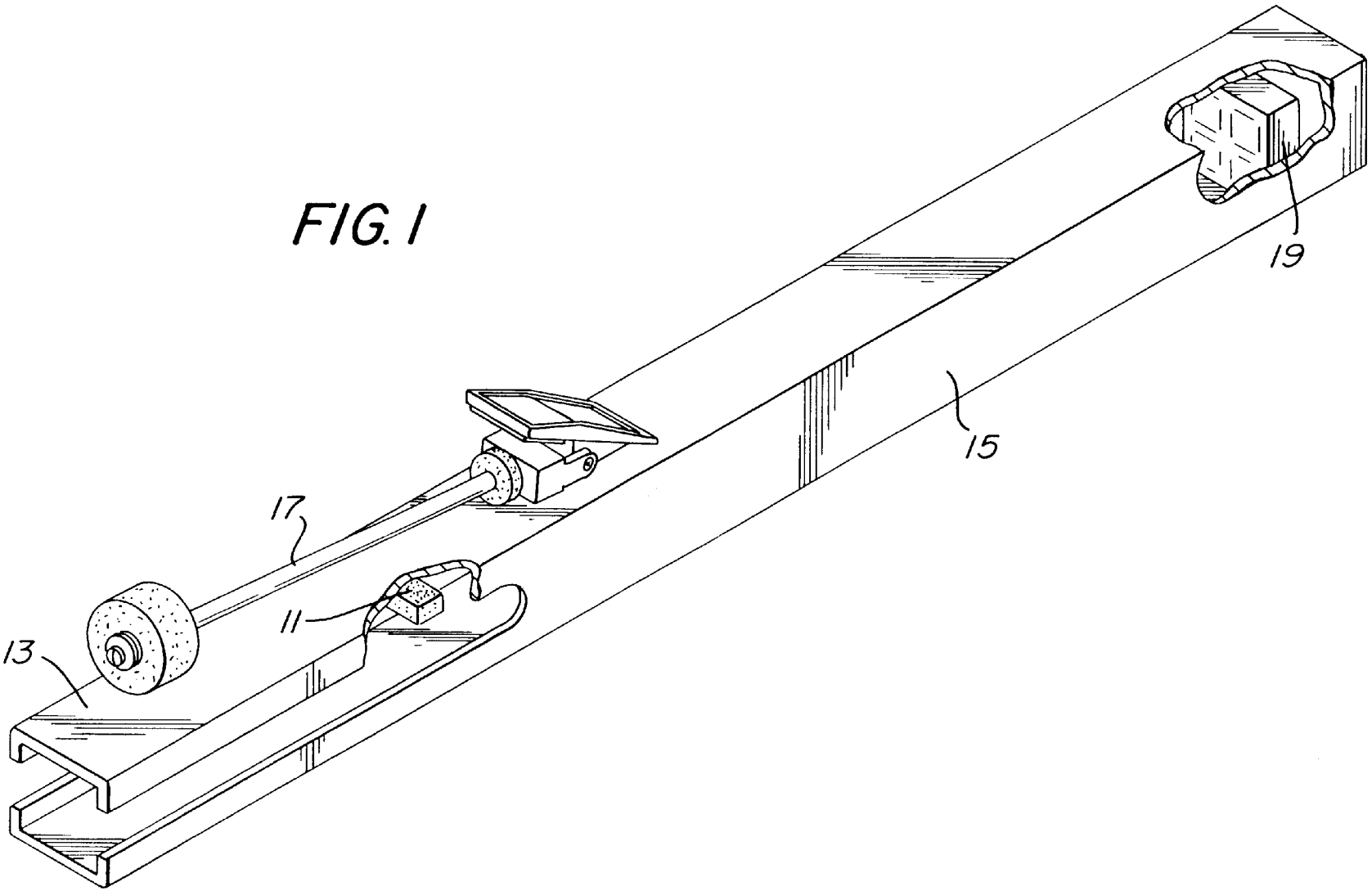
FIG. 1 is a top right front perspective view of the present invention in partial cutaway.

Referring now to FIG. 1, a handchime which utilizes the present invention is shown which includes the main tube 15 and clapper assembly 17. Internal tuning plug 19 is fitted within the tube to enhance the sound by adjusting the length of the column of air at the end of the tube opposite the tines. The present invention comprises an elastomeric damper block 11 which is fitted internally against the upper tine 13 of the handchime and dimensioned so that it is wedged internally between the sides of the upper tine. The damper block is preferably an oversized strip of elastomeric material which is compressed as it is installed so that it is pressed against the sides of the tine to produce effective vibration damping at that point. In addition, the damper block material is preferably secured in place by an adhesive located between the surface of the tine and the damper block.

Figure 2:
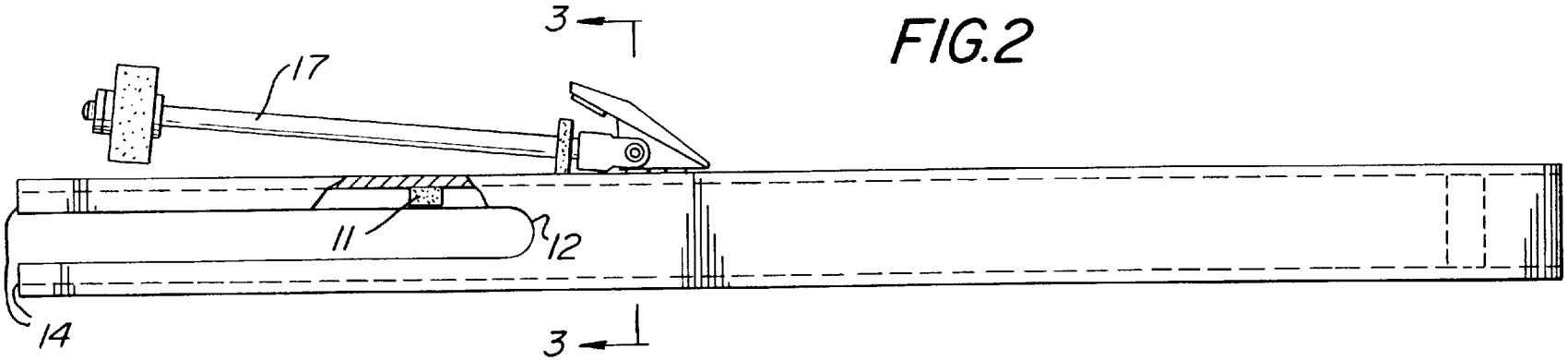
FIG. 2 is a right side elevation view of the present invention in partial cutaway.

Referring now to FIG. 2, the position of the damper block 11 of the present invention is more clearly shown. Theoretically, the ideal location of the damper block is approximately one-third the distance of the length of the tines from the point 12 where the tines begin. This position may be adjusted to compensate for the ear of the tuner to produce the greatest desired enhancement of the sound. As shown in this figure, the block is located internally and does not affect the operation of the clapper assembly 17. The damper block 11 does not protrude externally and therefore is not susceptible to damage or any contact that would cause it to become misaligned.

Figure 3:
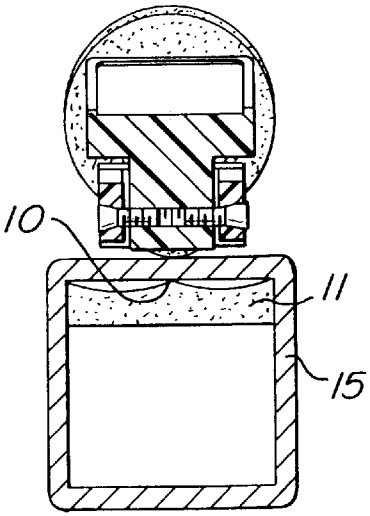
FIG. 3 is a rear sectional view taken from FIG. 2 as shown in that figure.

Referring now to FIG. 3, the elastomeric damper block 11 of the present invention preferably has a free length which is greater than the width of the handchime tube 15. As it is installed, it is compressed and its resilience acts to apply pressure against the sides of the tube at a point along its length where it has been found that the unwanted overtones are produced. The damper block 11 may be further secured in place by an adhesive. As shown in this figure, the damper block 11 includes a centrally located ridge 10 to hold most of its surface area, which occurs in two valleys on either side of the ridge, away from the inside surface of the top of the tine which is its major vibrating surface. A ridge also occurs at each side of the damper block and, therefore, the damper block has a plurality of raised portions in contact with the horizontal inside surface of the tine. The use of this ridged profile facilitates placement and installation of the damper block. The damper block is preferably composed of neoprene, but may be made from any suitable elastomeric material. This profile is clearly shown in FIG. 3.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A handchime, comprising:

a tubular body with an integrally-mounted clapper for impacting a tine located at one end of the body: and an oversized elastomeric damper block held in place by press-fit between inside surfacees of side walls of said tine.

2. The handchime of claim 1, wherein said damper block is located at a distance approximately one-third of the length of the tine from a base of said tine.

3. The handchime of claim 2, further described in that said damper block includes raised portions in contacting relationship with the inside horizontal surface of the tine.

4. The handchime of claim 3, wherein said damper block is secured to said side walls by an adhesive.

5. The handchime of claim 4, wherein said side walls are planar.

6. The handchime of claim 5, wherein said tubular body has a rectangular cross-section.

7. The handchime of claim 6, wherein said tubular body has a square cross-section.

8. A handchime, comprising:

a main tube having two opposite ends;

a first of said ends being forked and having tines;

a second of said ends being suitable for grasping as a handle;

an oversized elastomeric damper block held in place by press-fit between inside surfaces of side walls of one of said tines; and clapper means for striking one of said tines, said clapper means being attached to said main tube by hinge means.

9. The handchime of claim 8, wherein said damper block is located at a distance approximately one-third of the length of the tine from a base of said tine.

10. The handchime of claim 9, further described in that said damper block includes raised portions in contacting relationship with the horizontal inside surface of the tine.

11. The handchime of claim 10, wherein said damper block is secured to said side walls by an adhesive.

12. The handchime of claim 11, wherein said side walls are planar.

13. The handchime of claim 12, wherein said tubular body has a rectangular cross-section.

14. The handchime of claim 13, wherein said tubular body has a square cross-section.

* * * * *